United States Patent [19]

Suzuki

[11] Patent Number: 4,864,832

[45] Date of Patent: Sep. 12, 1989

[54] AIR CONDITIONER SYSTEM FOR AUTOMOBILES

[75] Inventor: Nobuhiko Suzuki, Konan, Japan

[73] Assignee: Diesel Kiki Co., Ltd., Tokyo, Japan

[21] Appl. No.: 299,563

[22] Filed: Jan. 18, 1989

Related U.S. Application Data

[62] Division of Ser. No. 98,992, Sep. 21, 1987, Pat. No. 4,815,300.

[30] Foreign Application Priority Data

Oct. 7, 1986 [JP] Japan ..... 61-238784

[51] Int. Cl.[4] ..... B60H 1/32

[52] U.S. Cl. ..... 62/133; 62/158; 62/228.3; 62/228.5; 62/209

[58] Field of Search ..... 62/133, 243, 228.1, 62/228.3, 228.5, 158, 209; 165/43; 251/129.17, 129.08

[56] References Cited

U.S. PATENT DOCUMENTS

| | | | |
|---|---|---|---|
| 3,168,242 | 2/1965 | Diener | 251/129.08 |
| 4,132,086 | 1/1979 | Kountz | 62/228.5 |
| 4,487,029 | 12/1984 | Hidaka et al. | 62/133 |
| 4,561,260 | 12/1985 | Nishi et al. | 62/133 X |
| 4,606,197 | 8/1986 | Takahashi et al. | 62/133 |
| 4,698,977 | 10/1987 | Takahashi | 62/133 |

*Primary Examiner*—Harry B. Tanner

*Attorney, Agent, or Firm*—Wenderoth, Lind & Ponack

[57] ABSTRACT

An automobile air conditioner system includes a variable displacement compressor having a wobble plate and a pressure control valve disposed in the compressor for controlling the pressure in a crank chamber. The pressure control valve is operative under the control of predetermined conditions, such as the temperature of an evaporator.

9 Claims, 7 Drawing Sheets

AIR CONDITIONER SYSTEM FOR AUTOMOBILES

This application is a division of application Ser. No. 098,992, now U.S. Pat. No. 4,815,300.

BACKGROUND OF THE INVENTION

1. Field of the Invention:

The present invention relates generally to air conditioner systems for automotive vehicles, and more particularly to an automobile air conditioner system including a variable displacement compressor.

2. Prior Art:

There have been proposed various automobile air conditioner systems of the type described. One such proposal is disclosed in Japanese Patent Laid-open Publication No. 60-162087. The disclosed system includes a solenoid valve for relieving the pressure in a crank room in a compressor toward the intake side of the compressor. The solenoid valve is contolled to open and close at a duty ratio according to the thermal loads in a vehicle compartment to be cooled, thereby adjustably controlling the displacement of the compressor.

The disclosed system thus constructed is disadvantageous however in that an electric circuit incorporated in the system is complicated in construction due to the necessity of a duty pulse generator and, for stable control, a feedback control based on continuous detection of, for example, the temperature of an evaporator.

SUMMARY OF THE INVENTION

It is accordingly an object of the present invention to provide an air conditioner system for automobiles, which is simple in construction and is capable of providing a fine controlled air conditioning.

According to the present invention, the foregoing and other objects are attained by an air conditioner system for an automobile, which comprises, as shown in FIG. 1 of the accompanying drawings, a variable displacement compressor 8 including a pressure control valve 18 for adjusting the amount of fluid-pressure relief from a crank chamber to a low pressure chamber to vary the tilt angle of a wobble plate 31; the pressure control valve 18 including a valve element 53, a pressure-responsive member 54 connected to the valve element 53 and capable of expand and contract in response to an intake pressure of the compressor 8, and a solenoid 47 for regulating a thrust on the valve element 53; a signal generator 110 including a temperature setter and at least one sensor; a discriminator 120 for making a judgment whether an output signal from the signal generator 110 meets a predetermined condition; and an operation controller 130 responsive to the judgment by the discriminator 120 for controlling an electric current supply to the solenoid of the pressure control valve.

With this construction, an output signal from the signal generator 110 is judged by the discriminator 120 as to whether it meets a predetermined condition. In response to the result of this judgment, the operation controller 130 varies the electric current supply to the solenoid 47 of the pressure control valve 18, thereby controlling the operation of the pressure control valve 18. With this arrangement, a duty pulse generator or the like complicated circuit is no longer necessary and a fine controlled air conditioning is accomplished.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

The present invention will now be described in detail with reference to preferred embodiments taken in conjunction with the accompanying drawings.

Figure 2:
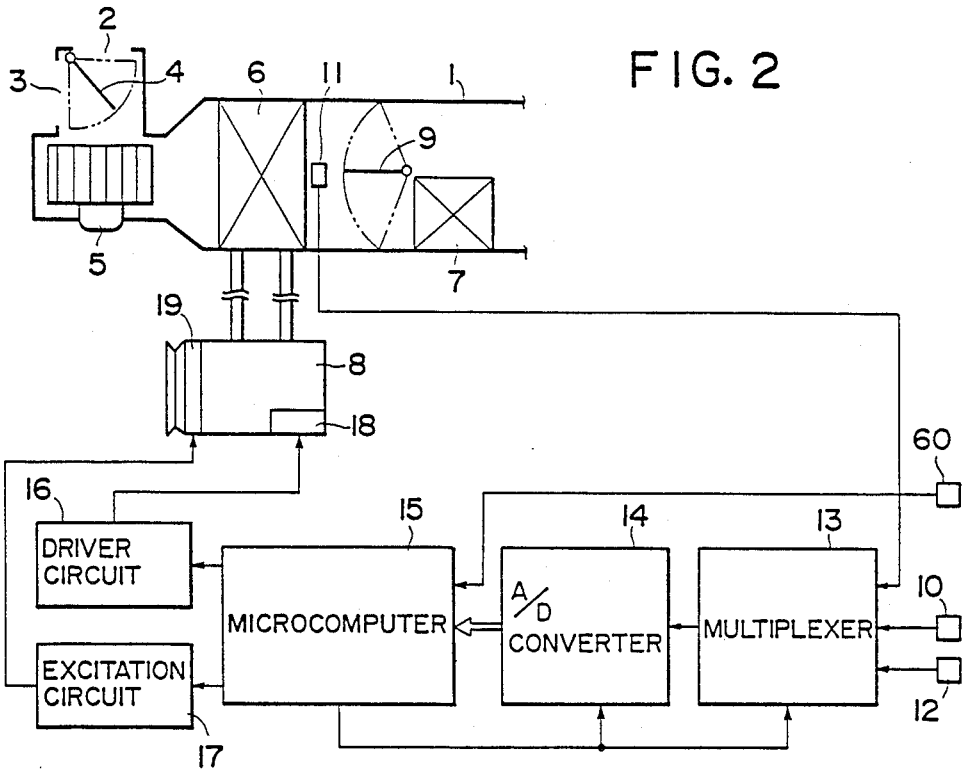
FIG. 2 is a diagrammatic view showing the general construction of an embodiment of the automobile air conditioner system.

Referring to FIG. 2, there is shown an automobile air conditioner system according to the present invention. The air conditioner system comprises an air flow duct 1 having a recirculated air inlet 2 and an outside air inlet 3 provided in branched fashion at an upstream end of the duct 1. A door 4 is provided between the branched inlets 2 and 3 to select one of the inlets 2, 3.

A blower 5 is disposed in the duct 1 immediately downstream of the inlets 2, 3 to force air through the duct 1 from left to right either from the recirculated air inlet 2 or the outside air inlet 3. An evaporator 6 and a heater core 7 are successively disposed downstream of the blower 5.

The evaporator 6 is connected in fluid communication with a compressor 8 and other related components so as to constitute a refrigeration system or cycle. The heater core 7 is incorporated in a hot water system or cycle, not shown, in which engine cooling water is circulated.

An air mix door 9 is disposed in front of the heater core 7 and angularly movable to control the ratio of the amount of air flowing through the heater core 7 to the amount of air by-passing the heater core 7. The air mix door 9 is operatively controlled by an actuator, not shown. The air passed through the heater core 7 and the air by-passed the heater core 7 are mixed up with each other at the downstream side of the heater core 7. With this mixing, the temperature of air is adjusted at a desired value. The temperature-controlled air is then blown off from discharge openings into the vehicle compartment, not shown.

Reference numeral 10 denotes a temperature setter for setting the temperature in the vehicle compartment at a desired value, 11 a temperature sensor disposed adjacent to the evaporator 6 for substantially detecting the temperature of the evaporator 6, and 60 an acceleration switch operated to open and close in response to the degree of depression of an accelerator pedal.

The temperature setter 10, the temperature sensor 11 and an acceleration sensor 12 are connected in cirucit with a multiplexer 13. The multiplexer 13 is responsive to a command signal from a microcomputer 15 to select a signal to be inputted to an A/D converter 14 from the temperature setter 10, the temperature sensor 11 and the acceleration sensor 12. The accelertion switch 60 is connected directly to the microcomputer 15. The A/D converter 14 converts analog signals delivered from the multiplexer 13 into digital signals of desired signal forms and then delivers the digital signals to the microcomputer 15.

The microcomputer 15 is of the type known per se and includes a central processing unit CPU, a read only memory ROM, a random access memory RAM, a clock pulse generator, and input and output ports I/O. The microcomputer 15, under the control of a program stored therein, processes input signals delivered from the A/D converter 14 and then produces output signals to be delivered to a driver circuit 16 and an excitation circuit 17.

The driver circuit 16 is operative to supply an excitation current to a solenoid coil of a pressure control valve 18 disposed in the variable displacement compressor 8. The excitation circuit 17 is operative to control on-off operation of an electromagnetic clutch 19 of the compressor 8.

Figure 1:
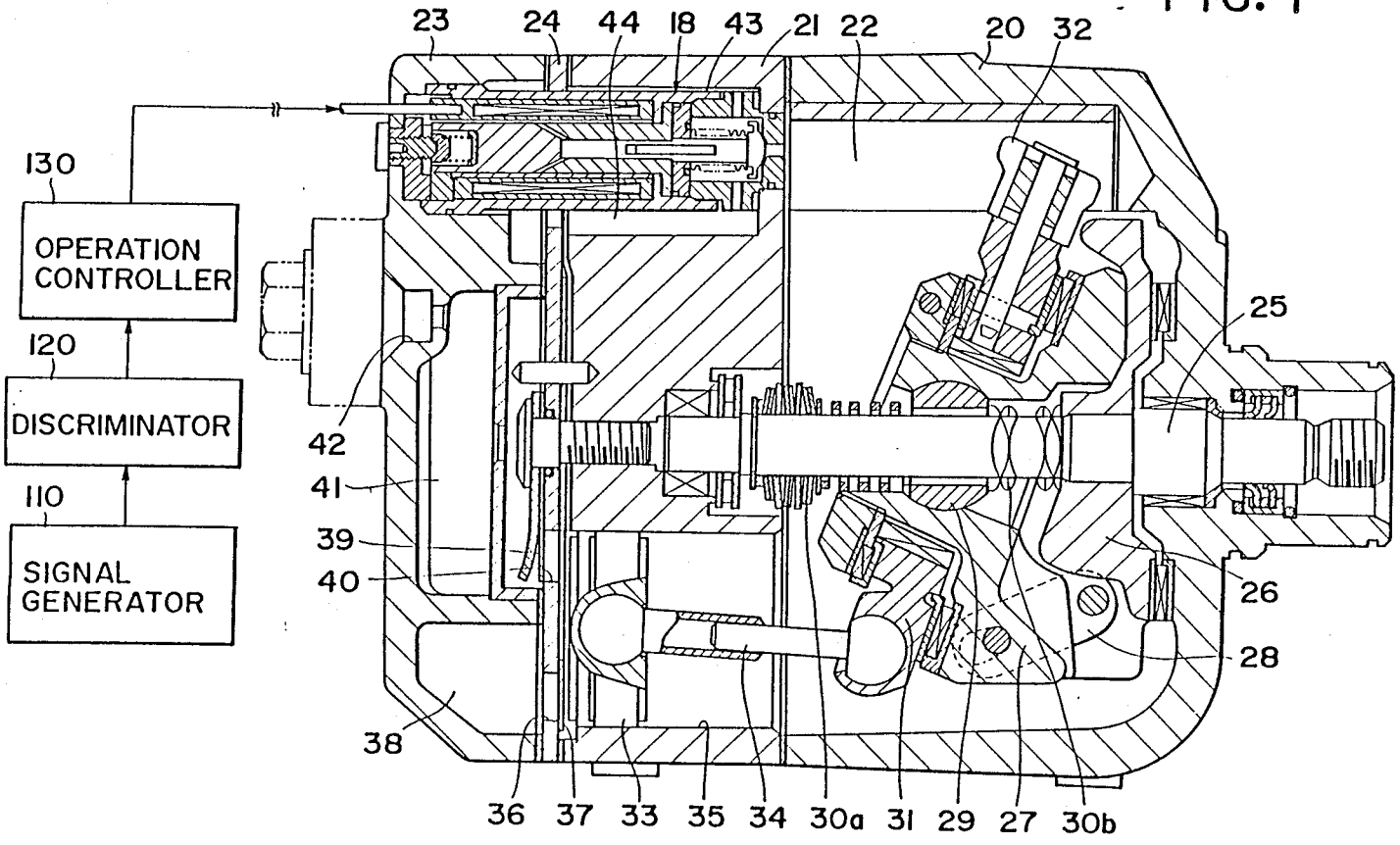
FIG. 1 is a diagrammatic view showing the general construction of an automobile air conditioner system according to the present invention.

The variable displacement compressor 8, as shown in FIG. 1, is of the swash or wobble plate type and includes a generally cup-shaped housing 20 and a cylinder block 21 secured to an open end of the housing 20 so as to define therebetween a crank chamber 22. A cylinder head 23 is secured to an outer end of the cylinder block 21 with a valve plate 24 disposed therebetween.

A drive shaft 25 is rotatably supported by the housing 20 and the cylinder block 21 and extends axially across the crank chamber 22. The drive shaft 25 slidably supports thereon a thrust flange 26 disposed within the crank chamber 22. The thrust flange 26 is pivotably connected to a drive hub 27 via a link 28. The drive hub 27 is rotatably pivotably supported on a hinge ball 29 fitted around the drive shaft 25. The hinge ball 29 is urged from opposite sides by a pair of resilient members **30*a*, 30*b* mounted on the drive shaft 25**.

A wobble plate 31 is supported in the crank chamber 22 and movable in such a manner that it is rotatable relative to the drive hub 27 and pivotable or oscillatable relative to the housing 22. The wobble plate 31 is held in engagement with the housing 20 via a slider 22. The wobble plate 31 is connected with a plurality of pistons 33 via connecting rods 34. The pistons 33 are slidably received in mating cylinder bores 35 formed in the cylinder block 21. Thus, there are defined between the valve plate 24, the piston 33 and the cylinder bores 35, a plurality of compression chambers. Each of the compression chambers communicates with a low pressure chamber 38 defined in the cylinder head 23 through an intake port 36 in the valve plate 24 when an intake valve 37 is open during the intake stroke of the piston 33. In the course of the discharge stroke of the piston 33, a discharge valve 39 is open to communicate the compression chamber with a high pressure chamber 41 through a discharge port 40 in the valve plate 24. The high pressure chamber 41 is defined in the cylinder head 23 independently from the low pressure chamber 38. The low pressure chamber 38 and the high pressure chamber 41 are connected respectively with an intake opening (not shown) and a discharge opening 42 both formed in the cylinder head 23.

The pressure control valve 18 is firmly fitted in a valve retaining hole 43 extending across the cylinder block 21, the valve plate 24 and the cylinder head 23. The valve retaining hole 43 has a lateral extension extending radially inwardly in the cylinder block 21 and defines, jointly with the outer peripheral wall of the pressure control valve 18, an intake pressure chamber 44 which is held in communication with the low pressure chamber 38.

Figure 3:
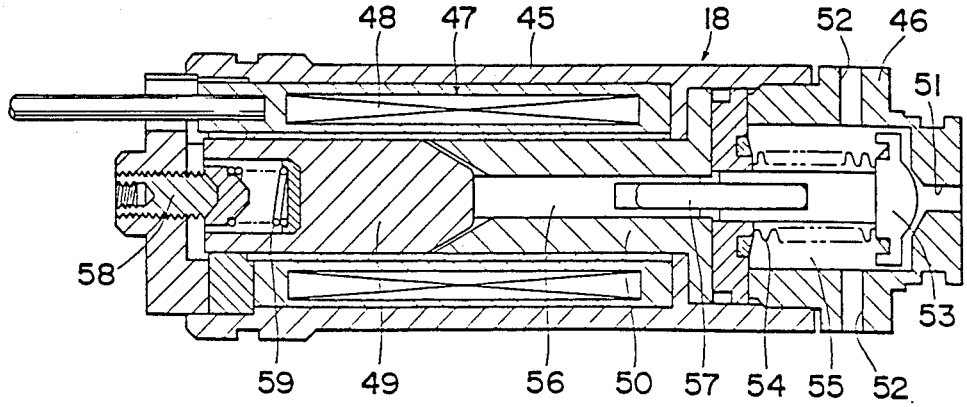
FIG. 3 is a longitudinal cross-sectional view of a pressure control valve incorporated in a variable displacement compressor of the automobile air conditioner system.

As better shown in FIG. 3, the pressure control valve 18 includes a tubular casing 45, a valve seat member 46 connected to one end of the casing 45, and a solenoid 47 disposed in the casing 45. The solenoid 47 is composed of an excitation coil 48, an armature 49 and a stator 50. The armature 49 is movable relatively to the casing 45 in the axial direction of the casing 45. The stator 50 is firmly secured to the casing 45. The armature 49 and the stator 50 have respective confronting tapered ends complementary in contour with each other for adjusting the thrust on a valve element 53 depending on a magnetic force produced between the armature 49 and the stator 50 when the excitation coil is energized.

The valve seat member 46 has a first connecting groove 51 connected with the crank chamber 22, and a second connecting groove 52 connected with the intake pressure chamber 44.

The first connecting groove 51 has an inner end terminated at a conical valve seat against which the poppet-like valve element 53 is seated. The valve element 53 is connected with a pressure-responsive member 54 in the form of a bellows, for example, received in a receiving chamber 55 which is held in communication through the second connecting groove 52 with the intake pressure chamber 44. The pressure-responsive member 54 contracts as the intake pressure increases so that the valve element 53 is pulled leftward in FIG. 3 by the pressure-responsive member 54 thus contracting. The valve element 53 is connected by a connecting pin 57 to a connecting rod 56 extending from the armature 49 through the annular stator 50. The valve element 53 is subjected to a thrust acting rightward in the same figure, the thrust increasing with an increase in magnetic force of the solenoid 47. The armature 49 is urged rightward by a thrust spring 59 whose pre-load is adjustably set by an adjustment screw 58. Thus, the valve element 53 is held in a position in which all of the intake pressure acting on the bellows 54, the magnetic force acting on the solenoid 47 and the force of the spring 59 acting on the armature 49 are ballancing with each other. With this force balancing, the open area between the valve element 53 and the valve seat, and hence the rate of communication between the crank chamber 22 and the intake pressure chamber 44 can be adjusted.

FIGS. 4 through 8 show flow charts each illustrative of a controlling operation of the pressure control valve 18 achieved under the control of the microcomputer 15. The operation is described with referernce to these drawing figures.

Figure 4:
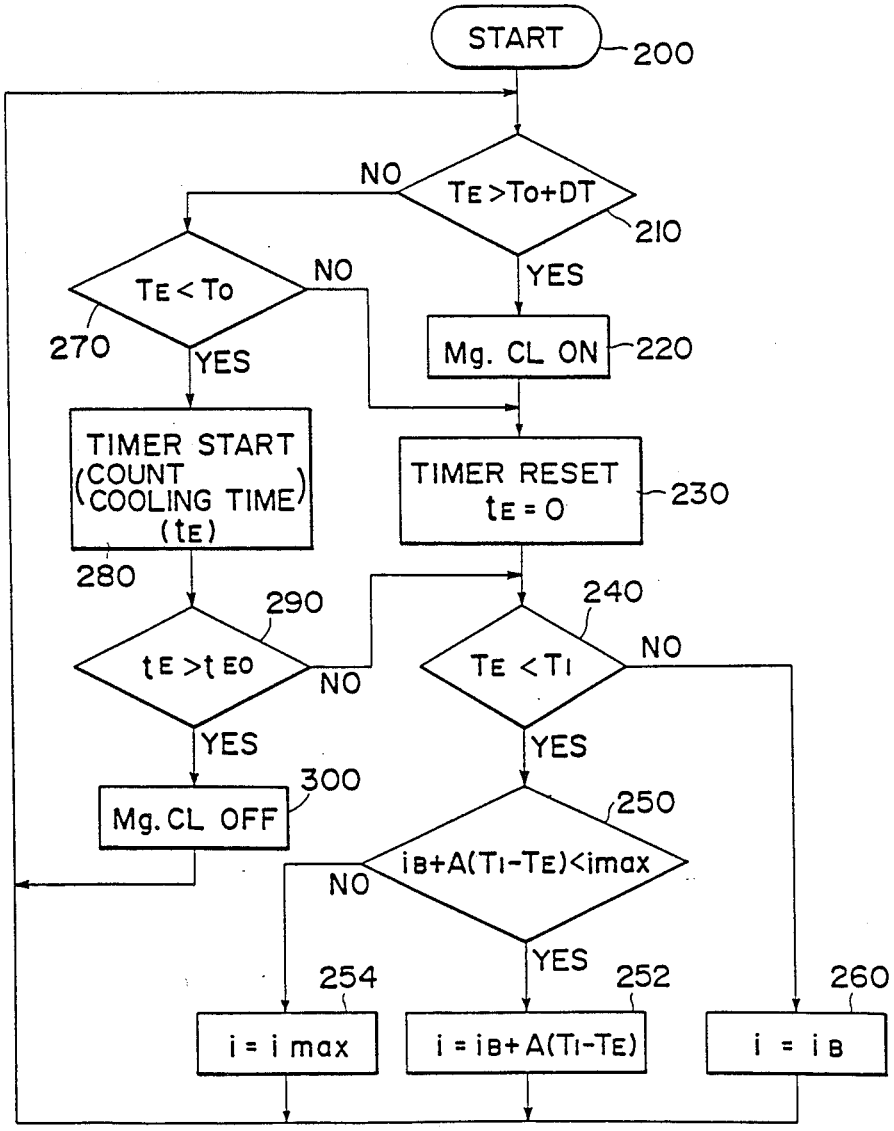
FIG. 4 is a flow chart showing a control routine for the compressor according to the temperature of an evaporator in the automobile air conditioner system.

FIG. 4 shows an embodiment in which the temperature of the evaporator 6 is used as a parameter for controlling operation of the pressure control valve 18.

When a non-illustrated main switch is closed, the microcomputer 15 is driven to proceed the program from a first step 200. In the next step 210, it is determined whether a detected temperature TE of the evaporator 6 inputted via the multiplexer 13 and the A/D converter 14 is higher than the sum of a reference temperature To and a hysteresis DT provided for stable operation. When it is judged that the evaporator temperature TE is greater than To+DT, then operation proceeds in the direction of "YES" to step 220. On the contrary, the judgment shows that the TE is smaller than the To+DT, the operation proceeds in the direction of "NO" to step 270.

In the step 220, the excitation circuit 17 is energized to engage the electromagnetic clutch 19 since the judgment of "YES" in the step 210 is indicative of a non-working condition of the refrigeration cycle. Then the operation proceeds to step 230.

In the step 230, the cooling period of time tE (described later on) is reset to zero. The operation proceeds to step 240 in which it is determined whether the evaporator temperature TE is smaller than a predetermined value T1. When it is judged that the TE is smaller than the T1, then the operation proceeds in the direction of "YES" to step 250. On the contrary, when the judgment indicates that the TE is greater than the T1, the operation then proceeds in the direction of "NO" to step 260.

In the step 250, it is determined whether an output current i of the driver circuit 16 is smaller than the maximum current imax of the driver circuit 16 in accordance with the equation: $i=iB+A(T1-TE)$ where iB represents a normal output current and A is a constant of proportion. The output current of the driver circuit 16 is variable with the setting in temperature setter 10. More specifically, the displacement in position of an adjustment dial (not shown) of the temperature setter 10 is variable with the variance of the output current iB at a constant of proportion of 1, as indicated by the dash-and-two dotted line shown in FIG. 9.

Figure 9:
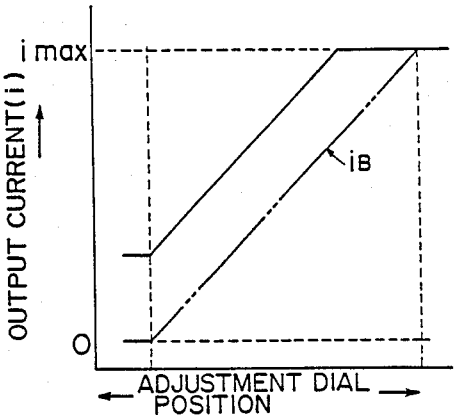
FIG. 9 is a graph showing the characteristics of an output current of a driver circuit observed when the compressor is controlled according to the evaporator temperature.

When the judgment in the step 250 indicates that the $iB+A(T1-TE)$ is smaller than the imax, then the operation proceeds in the direction of "YES" to step 252 in which the output current i is set to the value of $iB+A(T1-TE)$, as indicated by the solid line of FIG. 9. As a result, the valve element 53 of the pressure control valve 18 is displaced in a direction to close the first connecting passage 51 to an extent corresponding to the difference between the predetermined temperature T1 and the evaporator temperature TE. With this displacement, the intake pressure in the low pressure chamber 38 is increased, so the variable displacement compressor 8 is driven to operate at a reduced displacement.

If it is judged in the step 250 that the $iB+A(T1-TE)$ is greater than the imax, then the operation proceeds in the direction of "NO" to step 254 in which the output current i is set to the value of the imax. Consequently, the valve element 53 of the pressure control valve 18 is displaced in the direction to further close the first connecting passage 51, thereby enabling the variable displacement compressor 8 to operate at the minimum displacement.

If the judgment in the step 240 is "NO", the operation proceeds to the step 260, as described above. In the step 260, the output current iB is maintained without change. When the operation in the step 252, 254 or 260 has been completed, then the operation is repeated from the step 210 in the same manner as described above.

In case the operation proceeds to the step 270, it is determined whether the TE is higher than the To. If the judgment shows that the TE is lower than the To (i.e. the evaporator 6 is in fully cooled condition), then the operation proceeds in the direction of "YES" to step 280. On the contrary, when it is judged that the TE is higher than the To, then the operation proceeds in the direction of "NO" to step 230. In the latter case, the evaporator temperature TE is higher than the reference temperature To but is not higher than To+DT, as is apparent from the judgment in the preceding step 210.

In the step 280, judgment in the step 270 causes a timer to be started to count or measure a cooling period of time tE in which the evaporator temperature TE is kept smaller than the reference temperature To. In the next step 290, it is determined whether the cooling time tE thus counted is greater than a reference period of time tEo. When the judgment indicates that the tE is greater than the tEo, then the operation proceeds in the direction of "YES" to step 300 in which the excitation circuit 17 is de-energized to thereby disengage the electromagnetic clutch 19. Thereafter, the operation is repeated from the step 210 in the same manner as described above.

If it is judged in the step 290 that the tE is smaller than the tEo, then the operation proceeds in the direction of "NO" to step 240.

Figure 5:
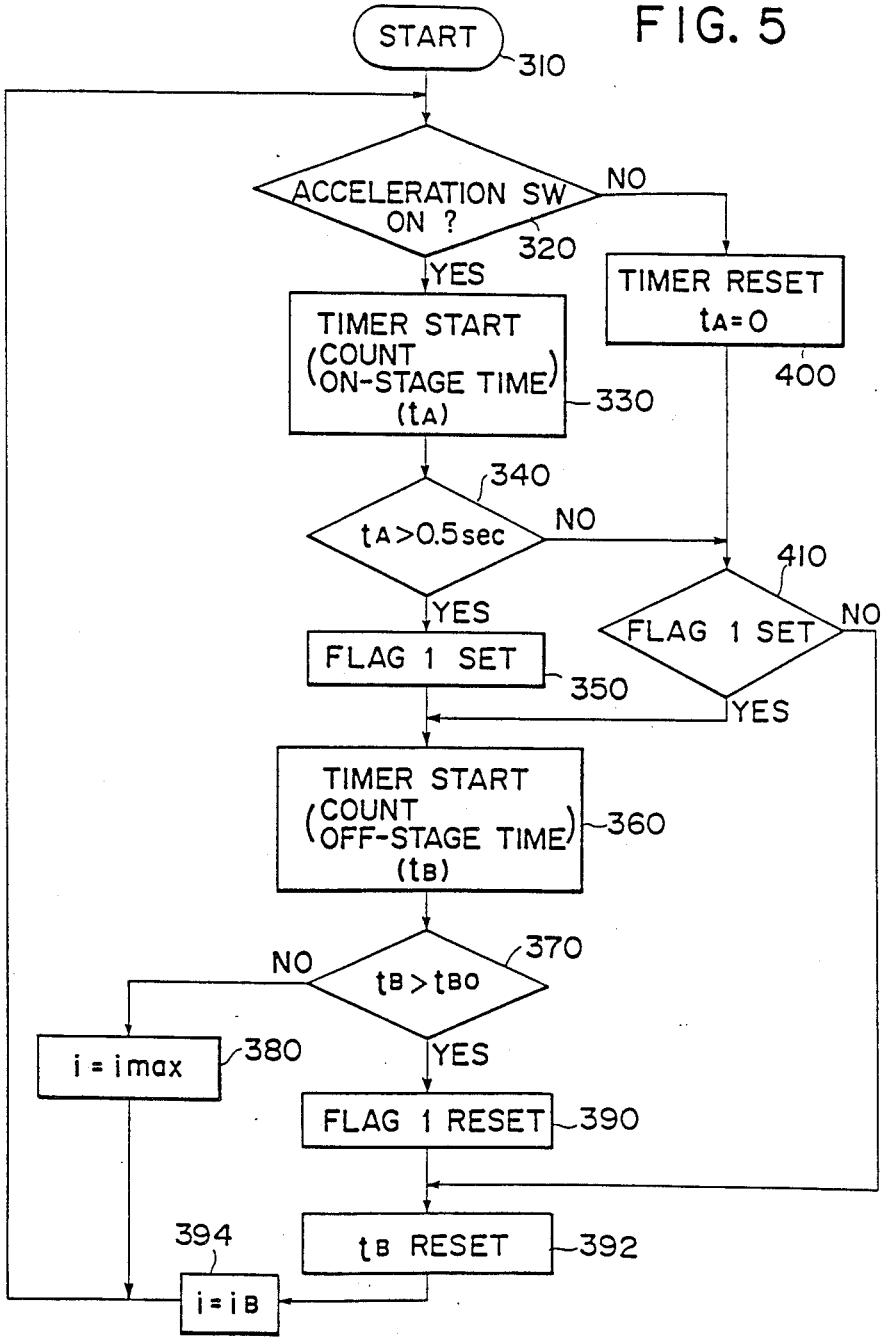
FIG. 5 is a flow chart showing a control routine for the compressor according to an acceleration switch.

FIG. 5 shows an embodiment in which the pressure control valve 18 is controlled under the on-off operation of the acceleration switch 60. In the same figure, the operation of the microcomputer 15 is started from step 310 down toward the next following step 320 in which it is determined whether the acceleration switch 60 is turned on. When the judgment shows the on-stage of the acceleration switch 60, the operation proceeds in the direction of "YES" to step 330. On the contrary, if it is judged that the acceleration switch 60 is turned off, then the operation proceeds in the direction of "NO" to step 400.

In the step 330, a timer is started to count or measure the period of time tA in which the acceleration switch 60 is maintained in the on-stage. Then the operation proceeds to step 340 in which it is determined whether the counted on-stage period of time tA is greater than 0.5 second. When the judgment shows that the tA is greater than 0.5 second, the operation proceeds in the direction of "YES" to step 350. On the contrary, if it is judged that the tA is smaller than 0.5 second, then the operation proceeds in the direction of "NO" to step 410.

In the step 350, an identification variable FLAG1 is set to the value of 1 for the separation of the processing procedures during repeated operations, then the operation proceeds to step 360. In the step 360, a timer is started to count or measure an operation period of time tB in which the output current is changed, then the operation proceeds to step 370.

In the step 370, it is determined whether the operation time iB is greater than a predetermined value tBo. When the judgment shows that the tB is smaller than the tBo, then the operation proceeds to step 380. On the contrary, if it is judged that the tB is greater than the tBo, then the operation proceeds to step 390.

Figure 10:
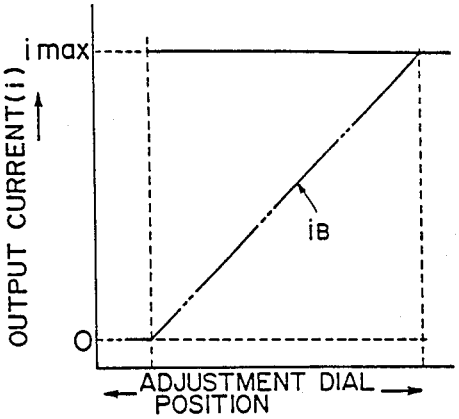
FIG. 10 is a graph showing the characteristics of an output current of the driver circuit observed when the compressor is controlled according to the acceleration switch.

In the step 380, the output current i is set to the maximum value of imax. As described above, the output current of the driver circuit 16 is set generally by manually turning the non-illustrated adjustment dial (see the dash-and-two dotted line in FIG. 9, however, in this step, setting of the output current i to the maximum value imax is accomplished as indicated by the solid line in FIG. 10. As a result, the valve element 53 of the pressure control valve 18 is displaced in a direction to close the first connecting groove 51, so the variable displacement compressor 8 is driven to run at the minimum displacement for a predetermined period of time. This time period is equal to the above-mentioned time period tBo and is set, for example, in the order of 30 seconds. Thereafter, the operation is repeated from the step 320 in the same manner as described above.

In the step 390, the variable FLAG1 is reset, and then the operation time tB is reset in the next following step 392. Subsequently, in step 394, the output current i is reset to the value iB. Then the operation is repeated from the step 320 in the same manner as described above.

Further, in the step 400, the timer is reset, namely tA=0, then the operation proceeds to step 410 in which it is determined whether the variable FLAG1 is set. When the judgment shows that the FLAG1 is set, then the operation proceeds to the step 360 to repeat the aforementioned operations on condition that the operation time tB is just after the setting of the output current to the value imax and has not reached to the predetermined value tBo. If it is judged that the FLAG1 is not set, the operation proceeds to the step 392.

Figure 6:
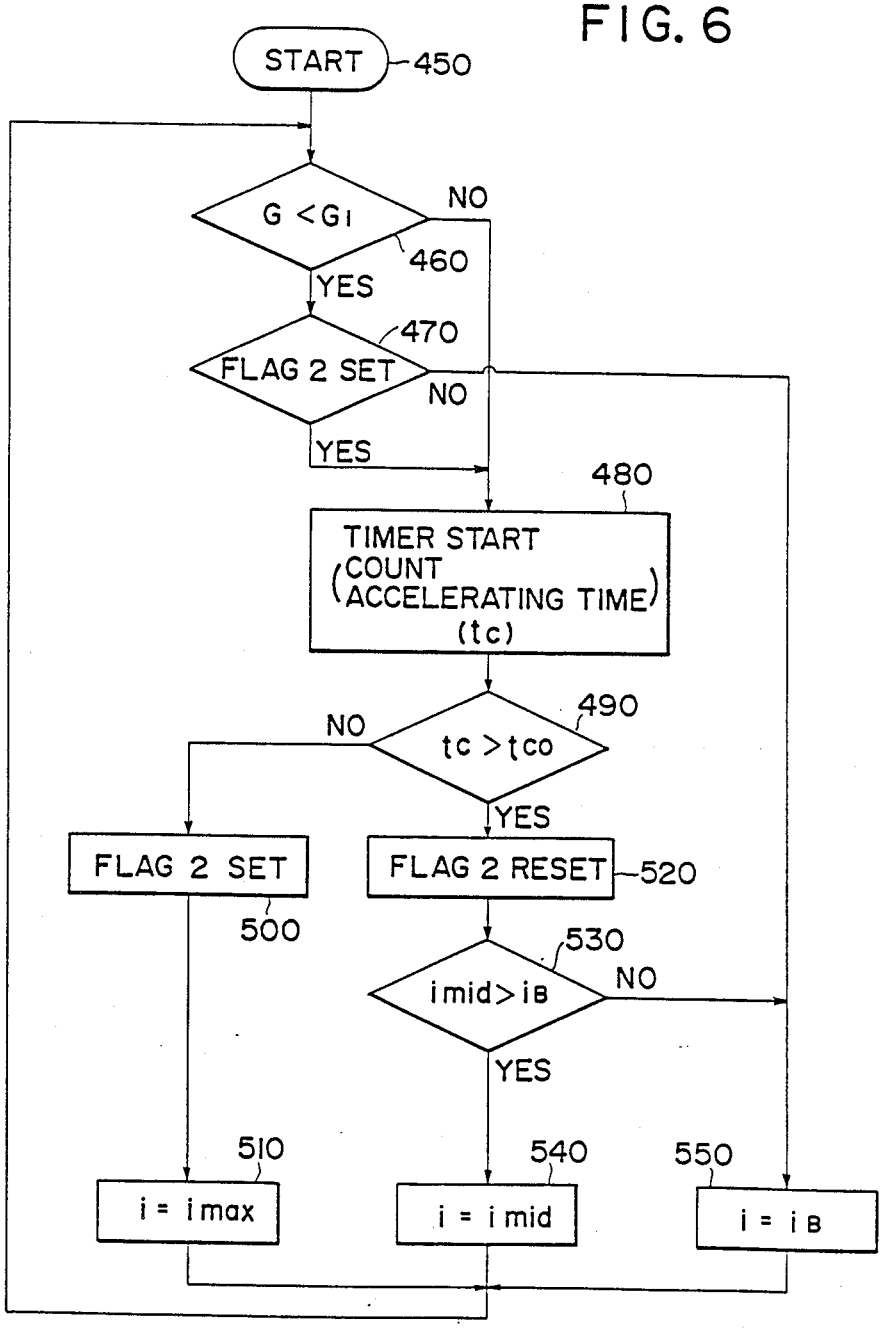

FIG. 6 shows an embodiment in which the pressure control valve 18 is operated under the control of the acceleration (or inclination). The operation of the microcomputer 15 process from step 450 down to the next step 460.

In the step 460, it is determined whether an acceleration (or inclination) inputted through the multiplexer 13 and the A/D converter 14 is greater than a predetermined value G1. When the judgment shows that the detected acceleration (or inclination) is greater than the value G1, then the operation proceeds to step 480. On the contrary, if it is judged that the detected acceleration (or inclination) is smaller than the value G1, then the operation proceeds to step 470.

In the step 470, it is determined whether a variable FLAG2 is set. The variable FLAG2 serves as an identifier for the separation of the processing procedures during repeated operations, and it is reset at the starting of the controlling operation. When the judgment shows that the variable FLAG2 is set, then the operation proceeds to step 480. On the contrary, if it is judged that the variable FLAG2 is reset, then the operation proceeds to step 550.

In the step 480, a timer is started to count or measure an acceleration period of time tc which in turn is subjected to a judgment as to whether the measured acceleration time tc is greater than a predetermined value tco. When the judgment shows that the tc is greater than the tco, then operation proceeds to step 520. On the contrary, if it is judged that the tc is smaller than the tco, then the operation proceeds to step 500.

Figure 11:
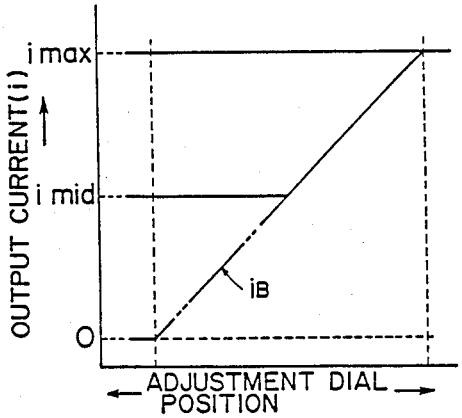
FIG. 11 is a graph showing the characteristics of an output current of the driver circuit observed when the compressor is controlled according to the acceleration.

In the step 500, the variable FLAG2 is set and then the operation proceeds to step 510 in which the output current i is set to the maximum value imax (see FIG. 11) for a predetermined period of time. This setting time is equal to the predetermined value tco. As a result, the valve element 53 of the pressure control valve 18 is displaced in a direction to close the first connecting groove 51, so that the variable displacement compressor 8 is driven to operate at the minimum displacement.

Since the acceleration sensor (or inclination sensor) of the standard type does not discriminate the acceleration and the inclination, it is not possible to make a judgment as to whether the vehicle is speeding up or is going up a slope. In view of this difficulty, according to this embodiment, the detected accelerating condition or the inclining condition is first interpreted as the accelerating condition by means of the foregoing control routine, and under this interpretion, the displacement of the variable displacement compressor 8 is set to the minimum value.

On the contrary, when the judgment in the step 490 shows that the tc is greater than the tco, then the variable FLAG2 is reset in the step 520. Subsequently, the operation proceeds to step 530 in which it is determined whether the output current iB of the driver circuit 16 is greater than a predetermined value imid. As indicated by the dash-and-two dotted line in FIG. 11, the output current iB is manually set by the non-illustrated adjustment dial in such a manner to vary in direct proportion to the positional displacement of the adjustment dial at a constant of proportion of 1. When the judgment shows that the iB is smaller than the imid, then operation proceeds to step 540 in which the output current i of the driver circuit 16 is set to the value imid. As a result, the variable displacement compressor 8 is driven to operate at an intermediate displacement (see FIG. 11). If the variable displacement compressor 8 is continuously driven at the minimum displacement even when the detected acceleration greater than the predetermined value G1 continues beyond the predetermined period of time tco, then a comfortable cooled condition could not be maintained. According to this embodiment, however, such continuing acceleration is interpreted as an ascending condition of the vehicle by means of the control routine with the result that the displacement of the variable displacement compressor 8 is changed from the minimum value to the intermediate value. With this arrangement, it is possible to avoid an undesirable increase in engine loads and an uncomfortable temperature rise which would otherwise occur when the variable displacement compressor 8 is driven at the minimum displacement for a long period of time. After the step 540 has been completed, the operation is repeated from the step 460 in the same manner as described above.

On the other hand, if the judgment in the step 530 shows that the output current iB is greater than the value imid, then the operation proceeds in the direction of "NO" to the step 550 in which the output current i is set to the normal value (i.e., i=iB). Thereafter the operation is returned to the step 460.

Figure 7:
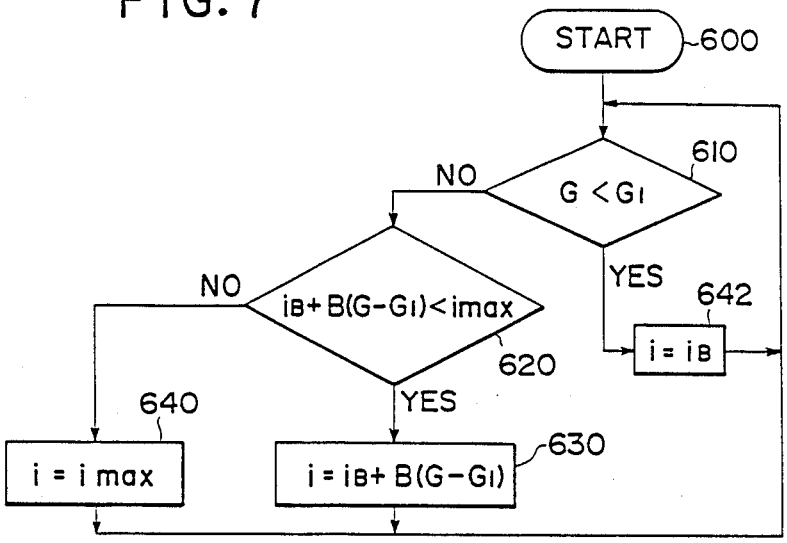
FIG. 7 is a flow chart showing another control routine for the compressor according to the acceleration.

FIG. 7 shows another embodiment in which the pressure control valve 18 is controlled according to the acceleration. In the same figure, the microcomputer 15 proceeds its operation from step 600 down toward the next step 610 in which it is determined whether a detected acceleration G is greater than the predetermined value G1. When the judgment indicates that the G is greater than the G1, then the operation proceeds to step 620 in which it is determined whether a value iB+B(G−G1) is greater than the value imax where iB represents the output current of the driver circuit 16 generally set manually, and B is a constant of proportion. If it is judged that the iB+B(G−G1) is greater than the imax, then the operation proceeds to step 640. On the contrary, when judgment shows that the iB+B(G−G1) is smaller than the imax, then the operation proceeds to step 630.

Figure 12:
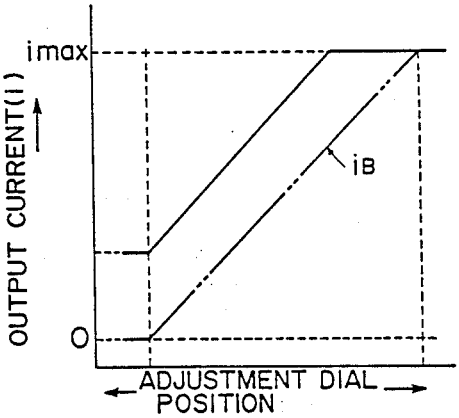
FIG. 12 is a graph similar to FIG. 11, but showing another mode of control of the compressor according to the acceleration.

In the step 630, the output current i of the driver circuit 16 is set to the value of iB+B(G−G1), as indicated by the solid line in FIG. 12. Consequently, the variable displacement compressor 8 reduces its displacement to an extent corresponding to an increase of the output currect, namely B(G−G1).

On the other hand, in the step 640, the output current i is set to the value of imax so that the variable displacement compressor 8 is driven to operate at the minimum displacement. Upon completion of the steps 630, 640, the operation is repeated from the step 610 in the same manner as described above.

When the judgment in the step 610 shows that the detected acceleration G is smaller than the G1, then the operation proceeds to step 642 in which the output current i is maintained at the value iB, then the operation is returned to the step 610.

Figure 8:
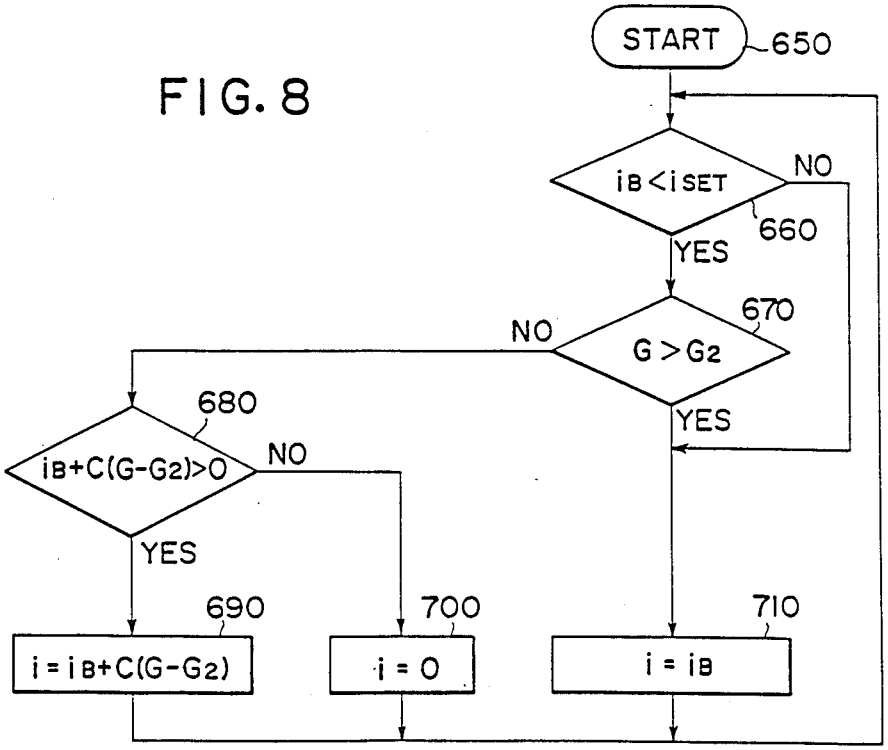
FIG. 8 is a flow chart showing a control routine for the compressor according to the deceleration.
Figure 13:
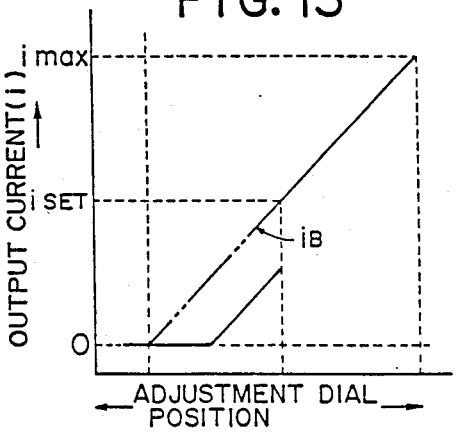
FIG. 13 is a graph showing the characteristics of an output current of the driver circuit observed when the compressor is controlled by the deceleration.

FIG. 8 shows an embodiment in which the pressure control valve 18 is controlled according to the deceleration of the vehicle. The microcomputer 15 proceeds its operation from step 650 down to the next step 660 in which it is determined whether a manually set output current iB of the driver circuit 16 (indicated by the dash-and-two dotted line in FIG. 13) is greater than a predetermined value iSET (see FIG. 13). When the judgment indicates that the iB is smaller than the iSET, then the operation proceeds to step 670. On the contrary, if it is judged that the iB is greater than the iSET, then the operation proceeds to step 710.

In the step 670, it is determined whether a detected acceleration G is greater than a predetermined value G2. When the judgment indicates that the G is smaller than the G2 (namely, a greater deceleration), then the operation proceeds to step 680. On the contrary, if it is judged that the G is greater than G2, then the operation proceeds to step 710. In the step 680, it is determined whether an output current i is zero according to the equation: i=iB+C(G−G2) where C is a constant of proportion. When the judgment shows that the output current i is smaller than zero, then the operation proceeds to step 700 in which the output current i is set to zero. On the contrary, if it is judged that the i is greater than zero, then the operation proceeds to step 690 in which the output current i is set to the value iB=C(G−G2), as indicated by the solid line in FIG. 13. Consequently, the displacement of the variable displacement compressor 8 is increased to an extent corresponding to a reduction of the output current, namely C(G−G2).

On the other hand, in the step 710, the output current i is maintained at the value iB. Upon completion of the steps 690, 700 and 710, the operation is repeated from the step 660 in the same manner as described above.

The acceleration sensor employed in the illustrated embodiments is of the type which disclosed in Japanese patent Laid-open Pblication No. 60-203861, for example, and which is capable of detecting the acceleration or the inclination. Further, the controlling operations of the respective illustrated embodiments are described as being achieved separately, however, any combination of these controlling operations is possible.

Obviously, many modifications and variations of the present invention are possible in the light of the above teachings. It is therefore to be understood that within the scope of the appended claims, the invention may be practiced otherwise than as specifically described.

What is claimed is:

1. An air conditioner system for an automobile, comprising:

a variable displacement compressor including a pressure control valve for adjusting the amount of fluid-pressure relief from a crank chamber to a low pressure chamber to vary the tilt angle of a wobble plate;

said pressure control valve including a valve element, a pressure-responsive member which is connected to said valve element and which expands and contracts in response to an intake pressure of said compressor, and a solenoid for regulating a thrust on said valve element;

a signal generator including a temperature setter and at least one sensor;

a discriminator for making a judgment as to whether an output signal from said signal generator meets a predetermined condition; and an operation controller responsive to the judgment made by said discriminator for controlling an electric current supply to said solenoid of said pressure control valve;

wherein said signal generator includes an acceleration switch adapted to be actuated when an acceleration pedal is depressed greater than a predetermined extent.

2. An air conditioner system according to claim 1, wherein said discriminator is operative to make a judgment as to whether said acceleration switch is being activated beyond a predetermined period of time.

3. An air conditioner system according to claim 2, wherein, when said judgment by said discriminator shows a continuous activation of said acceleration switch beyond the predetermined period of time, said operation controller is operative to set the electric current supply to said solenoid at a maximum value for a predetermined period of time.

4. An air conditioner system for an automobile, comprising:

a variable displacement compressor including a pressure control valve for adjusting the amount of fluid-pressure relief from a crank chamber to a low pressure chamber to vary the tilt angle of a wobble plate;

said pressure control valve including a valve element, a pressure-responsive member which is connected to said valve element and which expands and contracts in response to an intake pressure of said compressor, and a solenoid for regulating a thrust on said valve element;

a signal generator including a temperature setter and at least one sensor;

a discriminator for making a judgment as to whether an output signal from said signal generator meets a predetermined condition; and an operation controller responsive to the judgment made by said discriminator for controlling an electric current supply to said solenoid of said pressure control valve;

wherein said signal generator includes an acceleration sensor for detecting at least one of an inclination and an acceleration of the automobile.

5. An air conditioner system according to claim 4, wherein said discriminator is operative to make a judgment as to whether an acceleration or an inclination greater than a predetermined value is detected for a predetermined period of time.

6. An air conditioner system according to claim 5, wherein, when said judgment made by said discriminator indicates that the detected acceleration or inclination greater than the predetermined value continues more than the predetermined period of time, said operation controller is operative to set the electric current supply to said solenoid at one half of the maximum value.

7. An air conditioner system according to claim 4, wherein said discriminator is operative to make a judgment as to whether an acceleration or an inclination which is greater than a predetermined value has been detected.

8. An air conditioner system according to claim 7, wherein, when said judgment made by said discriminator indicates a detection of the acceleration or inclination greater than the predetermined value, said operation controller is operative to increase the electric current supply to said solenoid in accordance with the difference between the detected acceleration or inclination and the predetermined value.

9. An air conditioner system according to claims 7, wherein, when said judgment made by said discriminator indicates detection of an acceleration or inclination smaller than the predetermined value, said operation controller is operative to decrease the electric current supply to said solenoid in accordance with the difference between the detected acceleration or inclination and the predetermined value.

* * * * *